US005152528A

United States Patent [19]

Pasewalk

[11] Patent Number: 5,152,528

[45] Date of Patent: Oct. 6, 1992

[54] MAGNETIC RACE CAR GAME DEVICE

[76] Inventor: Leroy W. Pasewalk, 18815 Yukon Ave., Torrance, Calif. 90504

[21] Appl. No.: 814,815

[22] Filed: Dec. 31, 1991

[51] Int. Cl.[5] ..... A63F 9/00

[52] U.S. Cl. ..... 273/86 C; 273/456

[58] Field of Search ..... 273/86 R, 86 B, 86 C, 273/118 A, 138 R, 138 A, 456; 446/431, 437, 441; 272/4; 104/53, 60

[56] References Cited

U.S. PATENT DOCUMENTS

| | | | |
|---|---|---|---|
| 2,767,986 | 10/1956 | Newberry | 273/86 |
| 2,814,492 | 11/1957 | Mohlenbrock | 273/86 |
| 2,853,301 | 9/1958 | Glass | 273/86 |
| 3,502,332 | 3/1970 | Wolf | 273/86 C |
| 3,626,635 | 12/1971 | Birdsall | 273/86 |
| 3,658,333 | 4/1972 | Carcell | 273/86 C |

FOREIGN PATENT DOCUMENTS

| | | | |
|---|---|---|---|
| 2919947 | 11/1980 | Fed. Rep. of Germany | 273/86 B |

*Primary Examiner*—Benjamin H. Layno
*Assistant Examiner*—William M. Pierce
*Attorney, Agent, or Firm*—Richard C. Litman

[57] ABSTRACT

An amusement device is provided which permits the racing of cars. A housing is provided with a sloped ramp. The ramp has an upper portion and a lower portion. A starting gate is provided proximal to the upper portion. A handle is provided which will raise the gate when desired. Several disks are mounted on a shaft which is mounted inside the housing and underneath the ramp approximately intermediate the upper portion and the lower portion. There are a number of permanent magnets mounted on the disks, one less magnet mounted equidistantly on the disk than the number of total disks. The shaft is mounted on the inside of the housing on one side and passes through the housing on the other side. The shaft side which passes through the housing is connected to a knob. By turning the knob, the shaft will rotate. When the knob is turned, the shaft rotates, thus causing the rotation of the disks. There are a number of lanes corresponding to the number of cars. The number of disks are equal to the number of lanes. A permanent magnet is mounted securely on the base of each racing car. The disks place the magnets mounted to them normal to the bottom section of the ramp. As the cars pass over the location where the disk magnets are the motion of the cars are arrested. Only one car can pass.

6 Claims, 2 Drawing Sheets

MAGNETIC RACE CAR GAME DEVICE

FIELD OF THE INVENTION

The present invention relates to an amusement device or game. More specifically the instant invention relates to a magnetized game for the racing of miniaturized cars.

DESCRIPTION OF THE PRIOR ART

Devices which are designed for amusement which consider a race to a finish line are known in the art. U.S. Pat. No. 2,767,986 issued on Oct. 23, 1956 to Meigs Newberry discloses a racing game apparatus which uses a sloped track and small model cars. No magnetic devices are considered in altering the outcome of the race.

U.S. Pat. No. 2,814,492 issued to Karl Mohlenbrock on Nov. 26, 1957 discloses a racing game device for racing small model horses. A manually actuated starting gate and inclined game board are disclosed. No magnetic devices are considered in altering the outcome of the race.

U.S. Pat. No. 2,853,301 issued to Marvin Glass on Sep. 23, 1958 discloses a toy racing game. A starting gate and individual lanes are provided to permit pellet-type elements roll and slide down an inclined plane in an 'exciting' race which the outcome cannot be forecast. No magnetic devices are considered in altering the outcome of the race.

U.S. Pat. No. 3,626,635 issued to John Birdsall on Dec. 14, 1971 discloses a magnetically controlled car steering mechanism, designed to influence the direction of a model car travelling down an inclined ramp about a plurality of marked pathways. This game test the users skill in following a marked path.

U.S. Pat. No. 3,658,333 issued on Apr. 25, 1972 to John Carcell discloses a gravity operated horse racing game. An incline board is disclosed with a plurality of lanes and a starting gate. No magnetic devices are considered in altering the outcome of the race.

None of the above referenced devices, considered either singly or in combination, is seen to suggest the instant invention as claimed.

SUMMARY OF THE INVENTION

The instant invention an amusement device which includes a racing gate for miniaturized cars and a quasi random magnetic car stopping system which arrests game piece motion except in the case of the 'winner'. A plurality of cars are arranged in a side by side manner in the gate. A plurality of parallel lanes are provided, one lane per car. The lanes are integral and sloped. The gate is mechanically actuated by the user. This releases the cars, which begin to travel down the lanes due to gravitational force. Each car has a magnet attached to its bottom surface. Beneath each sloped lane is a variable magnetic source. The variable magnetic source acts in such a way where at any given time all of the lanes except one has a magnetic source acting. Through magnetic force placing an acceleration on the cars greater than the force due to the gravitational acceleration, the cars traveling in the lanes affected by the magnetic fields have their velocity come to zero. For example, if four lanes and cars are present, three of them will be brought to a halt by the magnetic forces.

Accordingly, one object of the present invention is to provide an amusement device which randomly assigns a winner.

Another object of the present invention is to use a magnetic device to arrest the linear motion of the model racing car.

A further object of the invention is to provide a race car game device or assembly which is uncomplicated in construction and low in cost of manufacture.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figures 1, 1A, 2:
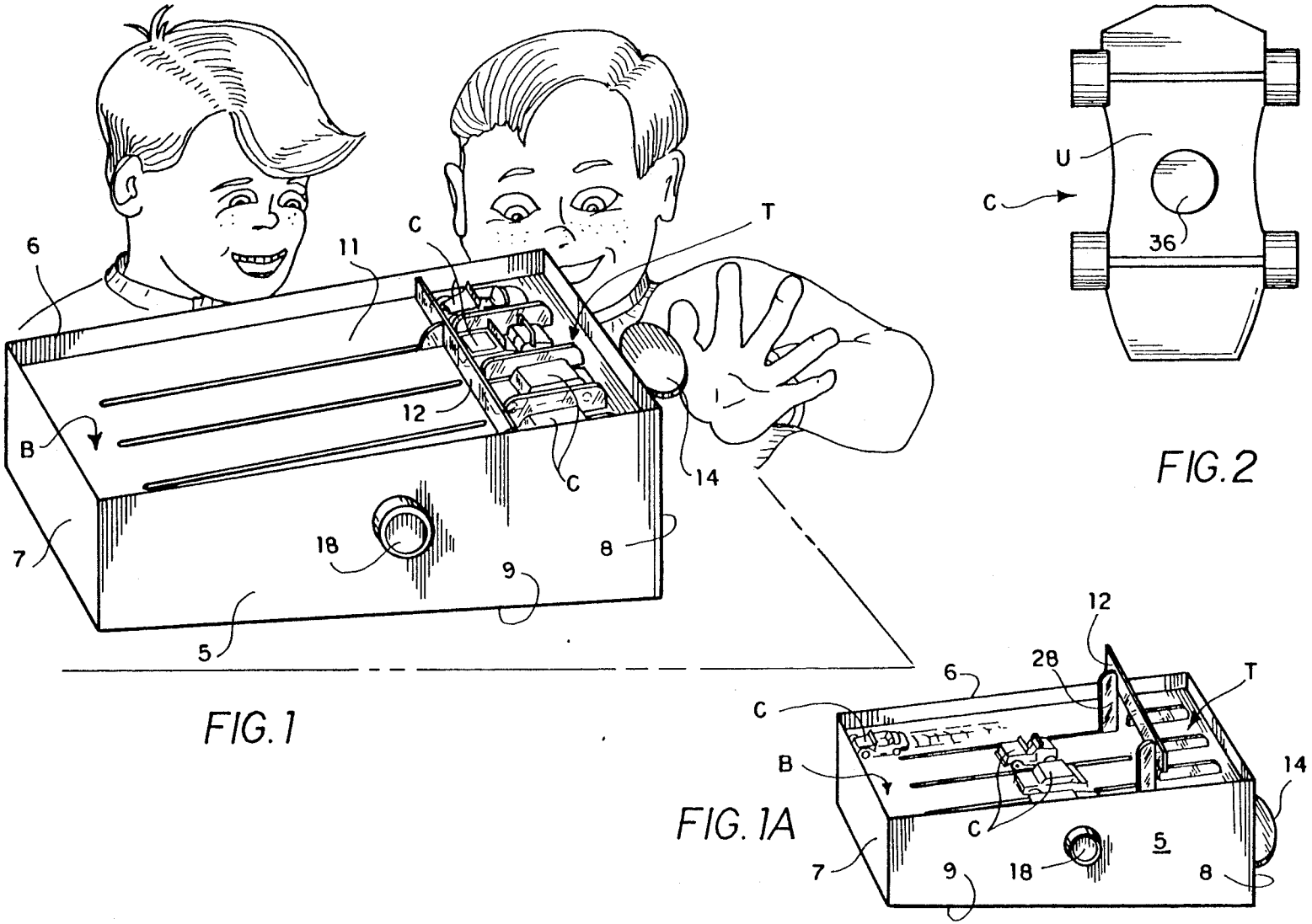
FIG. 1 is a environmental perspective view of the race car game.
FIG. 1A is a perspective view showing the action of the magnets arresting the downward motion of the model race cars.
FIG. 2 is a bottom view of one race car component of the game, showing the magnet mounted on the model car undercarriage.

The present invention is drawn to a miniature car racing apparatus which incorporates a magnetic system to influence the outcome or result of the race. An opaque rectangular housing is provided with a top sloped ramp. The housing is made up of a right side wall 5, left wall 6, front wall 7, rear wall 8, and a bottom 9, all connected together to form a substantially rectangular box. The rear wall 8 has a greater height than the front wall 7, the side walls 5, 6 having inclined upper edges interconnecting the top edges of the front wall 7 and rear wall 8. A sloped cover element 11 which acts as a track froms the top of the housing. The cover element 11 has an upper side and an under side, the upper side being separated into four equal portions which act as lanes for the cars C. The cover element 11 forms a ramp with a top portion T and a lower portion B. At the top portion T the starting line for the race is located, and on the lower portion B the finish line is provided. A starting gate 12 is provided which holds the model or miniature cars C in place until it is raised through the action of a mechanical lever 14, the details which are described below.

Inside the housing a shaft S is mounted approximately intermediate and below the ramp top portion T and lower portion B. It is mounted interiorly of the left side wall 6 by a mounting bracket 16. The shaft S passes through the right side wall 5 and terminates in the mounting bracket 16 located inside the left wall 6. A knob 18 is fitted to the exteriorly protruding portion of the shaft S which permits one to rotate the shaft S.

Figure 5:
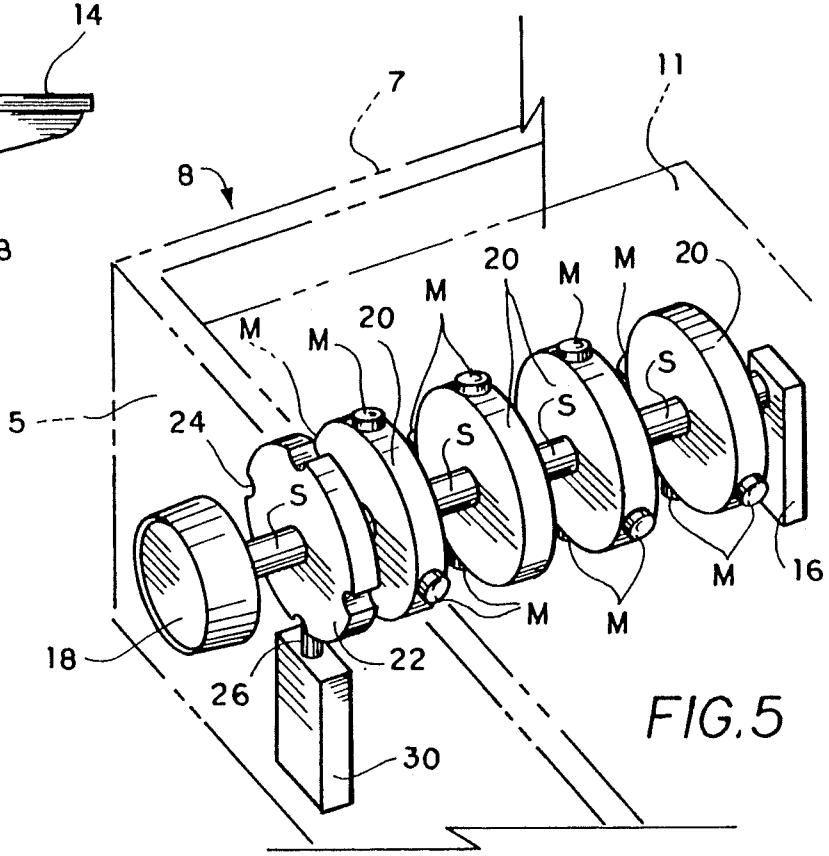
FIG. 5 is a perspective view of the internal magnet wheels mounted on the rotatable shaft.

In the preferred embodiment, four cylindrical disks 20 are provided with three permanent magnets M affixed to the surface area at 90 degree intervals as best shown in FIG. 5. If one considers a circle with 360 degrees, the magnets M are mounted at 0 degrees, 90 degrees, and 180 degrees with the 270 degree position having no magnet. These four disks 20 are mounted on the shaft S and are arranged in such a manner that the magnets M will just clear the bottom portion of the cover element 11 as the disks 20 are rotated. The magnets M are arranged in a precise geometric fashion. With reference to FIG. 5, beginning at the left side of the figure, and viewing the disks from the left side of the figure, the first disk is placed with the 90 degree magnet directly beneath the underside of the cover element 11. The second disk is mounted with the 180 degree magnet directly beneath the underside of the cover element 11. The third disk is mounted with the 0 degree magnet directly beneath the underside of the cover element 11. The fourth disk is mounted with the 270 degree position (the position WITHOUT a magnet) directly beneath the underside of the cover element 11 with the three permanent magnets M below it at ninety degree intervals. These disks 20 are mounted equally distant apart, one disk underneath the underside of each of the 4 lanes which are shown on the cover element 11, or ramp or raceway.

A scrag wheel 22 is provided on the shaft S, interior of the right side wall 5. Scrag wheel 22 has four depressions 24 located at 90 degree intervals and is mounted on the shaft S in such a manner that the depressions 24 are in alignment with the magnet positions on the disks 20. Underneath the scrag wheel 22 is a circular rod 26 with a half spherical top section 26A which mates with the depressions 24 on the scrag wheel 22. The rod 26 is urged against the scrag wheel 22 by a coil spring 28 held in a cylindrical opening in a rectangular solid mounting bracket 30 located below the scrag wheel 22. As the knob 18 is turned, the shaft S rotates, and the rod 26 will stop rotation at the 0 degree, 90 degree, 180 degree, and 270 degree positions, which brings three of the magnets M and one blank position into location directly beneath the underside of the cover element 11 at any of the above four positions of the scrag wheel 22.

Figure 3:
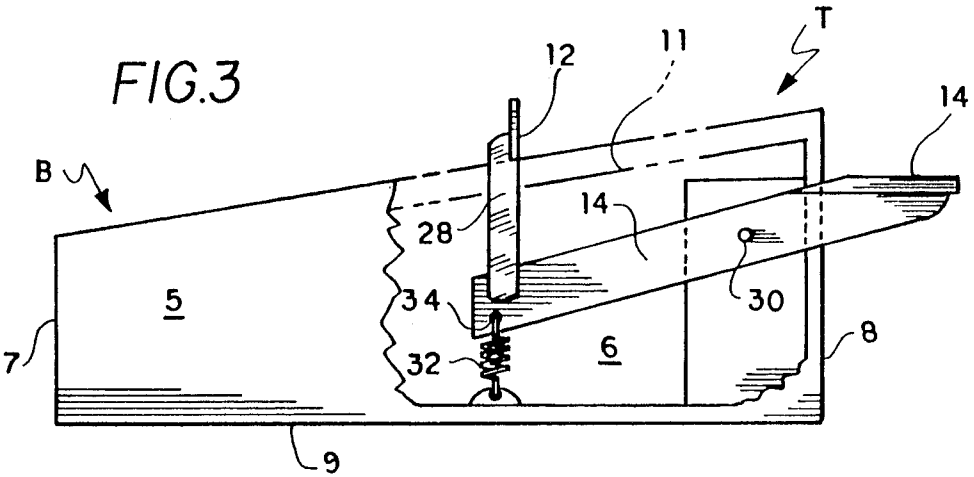
FIG. 3 is a cutaway, side elevational view showing the gate raising mechanism.
Figure 4:
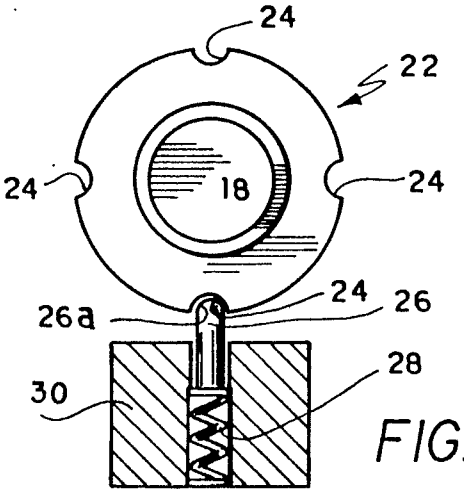
FIG. 4 is a view of the scrag wheel and spring which locks in rotation at 90 degree intervals.

Referring now to FIG. 3 the mechanical lever 14 passes through the center of the rear wall 18 where it is connected to the starting gate 12 by two posts 28 which pass through the cover or raceway ramp 11. A fulcrum 30 is provided for the lever 14. A coil spring 32 is secured to bottom 9 and to a distal portion of the lever 34 thus locating the starting gate 12 in a closed position. By pushing down the handle of the lever 14, the starting gate 12 is pushed up. This permits the race cars C to begin their descent down the ramp 11.

As shown in FIG. 2, each race car C is provided with a permanent magnet 36 securely affixed to its underside U. To begin the amusement, the race cars C are placed behind the starting gate 12 as shown in FIG. 1. The knob 18 is arbitrarily rotated placing the magnet wheels 20 in an unknown orientation beneath ramp 11. The gate lever 14 is depressed, raising the gate 12, and the cars C begin to roll down the raceway ramp 11. The motions of three of the four race cars C are arrested by the magnetic attraction created between the magnets 36 on the undercarriage U of the race cars C and the magnets M on the magnet wheels 20. The fourth race car continues down the ramp 11 to the lower portion B thus winning the race.

The instant invention includes embodiments with fewer than 4 lanes and magnet wheels as well as more than the aforedescribed 4 lanes and magnet wheels.

It is to be understood that the present invention is not limited to the sole embodiment described above, but encompasses any and all embodiments within the scope of the following claims.

I claim:

1. A plurality of model racing cars in combination with an apparatus for racing said cars, comprising;

an inclined raceway having a plurality of parallel racing lanes, said inclined raceway having an upper, top portion and a lower, bottom portion, a plurality of model racing cars, each car having a first permanent magnet securely affixed to an underside thereof, a starting gate, said starting gate being located on said inclined raceway top portion, such that said cars may be momentarily retained therebehind, means for opening said starting gate to permit said cars to be set in motion and to begin to traverse the length of said inclined raceway, means to arrest the motion of all but one of said cars intermediate of said raceway as said cars traverse the length of said inclined raceway, said means to arrest car motion comprising a plurality of second permanent magnets mounted on a plurality of rotatable wheels, said rotatable wheels being mounted on a shaft, said shaft having a shaft rotation means, whereby actuation of said shaft rotation means causes said shaft to rotate, varying said lane which said one of said cars may pass, there further being shaft rotation positioning means to randomly orient said rotatable wheel second magnets such that said second magnets are located directly, randomly beneath all of said racing lanes but one, whereby the motion of those cars passing over said second magnets directly beneath said raceway is arrested, the remaining cars continuing on to said raceway bottom portion.

2. The invention as claimed in claim 1 further comprising an opaque housing atop which said inclined raceway is mounted, said rotatable wheels being mounted within said housing, beneath said raceway.

3. The invention as claimed in claim 2 wherein said shaft rotation means comprise a knob mounted on said shaft exteriorly of said housing, said shaft extending through said housing, there further being scrag wheel means mounted on said shaft interiorly of said housing and click stop means associated with said scrag wheel means for tactile indication of proper positioning of said shaft with a plurality of said second magnets located directly beneath said raceway.

4. The invention as claimed in claim 1 wherein said starting gate opening means comprise a hand operated lever assembly means for raising said starting gate above said raceway, there further being coil spring means urging said starting gate downwardly against said raceway.

5. The invention as claimed in claim 1 wherein said racing lanes, racing cars, and rotatable wheels are each four in number, each of said rotatable wheels including three of said second magnets arranged substantially 90 degrees apart from one another on the periphery of each said wheel, said four rotatable wheels being fixed to said shaft and oriented thereon such that, as said shaft is rotated through 90 degree increments, three of said second magnets on three of said rotatable wheels will be positioned directly beneath said raceway with a fourth of said rotatable wheels positioned with none of its magnets directly beneath said raceway.

6. The invention as claimed in claim 1 wherein said shaft rotation means comprise a knob mounted on said shaft, there further being scrag wheel means mounted on said shaft, interiorly of said knob, and click stop means associated with said scrag wheel means for tactile indication of proper positioning of said shaft with a plurality of said second magnets located directly beneath said raceway.

* * * * *